US005899337A

United States Patent [19]

Thebeault

[11] Patent Number: 5,899,337

[45] Date of Patent: May 4, 1999

[54] COLLAPSIBLE OCTAGONAL BOX FOR HEAVY LOAD (5,000+ POUNDS)

[75] Inventor: Brian Joseph Thebeault, Galion, Ohio

[73] Assignee: Urban Industries, Inc., Galion, Ohio

[21] Appl. No.: 09/024,143

[22] Filed: Feb. 17, 1998

[51] Int. Cl.[6] ..... B65D 6/02; B65D 6/18

[52] U.S. Cl. ..... 206/600; 220/4.29

[58] Field of Search ..... 206/386, 600; 220/4.08, 4.09, 4.28, 4.29, 6

[56] References Cited

U.S. PATENT DOCUMENTS

| | | | |
|---|---|---|---|
| 4,098,424 | 7/1978 | Liebscher et al. | 220/4.29 |
| 5,564,599 | 10/1996 | Barber et al. | 206/600 X |
| 5,667,090 | 9/1997 | Langham, Jr. et al. | 220/4.29 X |

*Primary Examiner*—Jacob K. Ackun

*Attorney, Agent, or Firm*—Robert J. Fay, Esq.

[57] ABSTRACT

This invention relates to a collapsible box for shipments between plants of heavy loads up to 5,000+ pounds per box for heavy parts. The box is designed to be collapsible to be returned flat for less shipping costs. The box is fabricated in an octagonal shape made from 8 sides of hardboard on the outside, and a sheet of aluminum secured thereto with hinges holding the sides together in an octagon with strips holding the box on a pallet.

The hinges hold the sides together from the base on the pallet to the top of the box. The hinges are of two types. One hinge is a double pivot for opposite corners of the collapsed box, and it folds back on itself with two pivot points, shown in FIGS. 6 and 7. The other hinge folds from a flat position on the top or bottom of the collapsed position to a 45° bend inwardly toward the assembled box with only one pivot point, shown in FIG. 4 and 5.

7 Claims, 4 Drawing Sheets

FIG.1
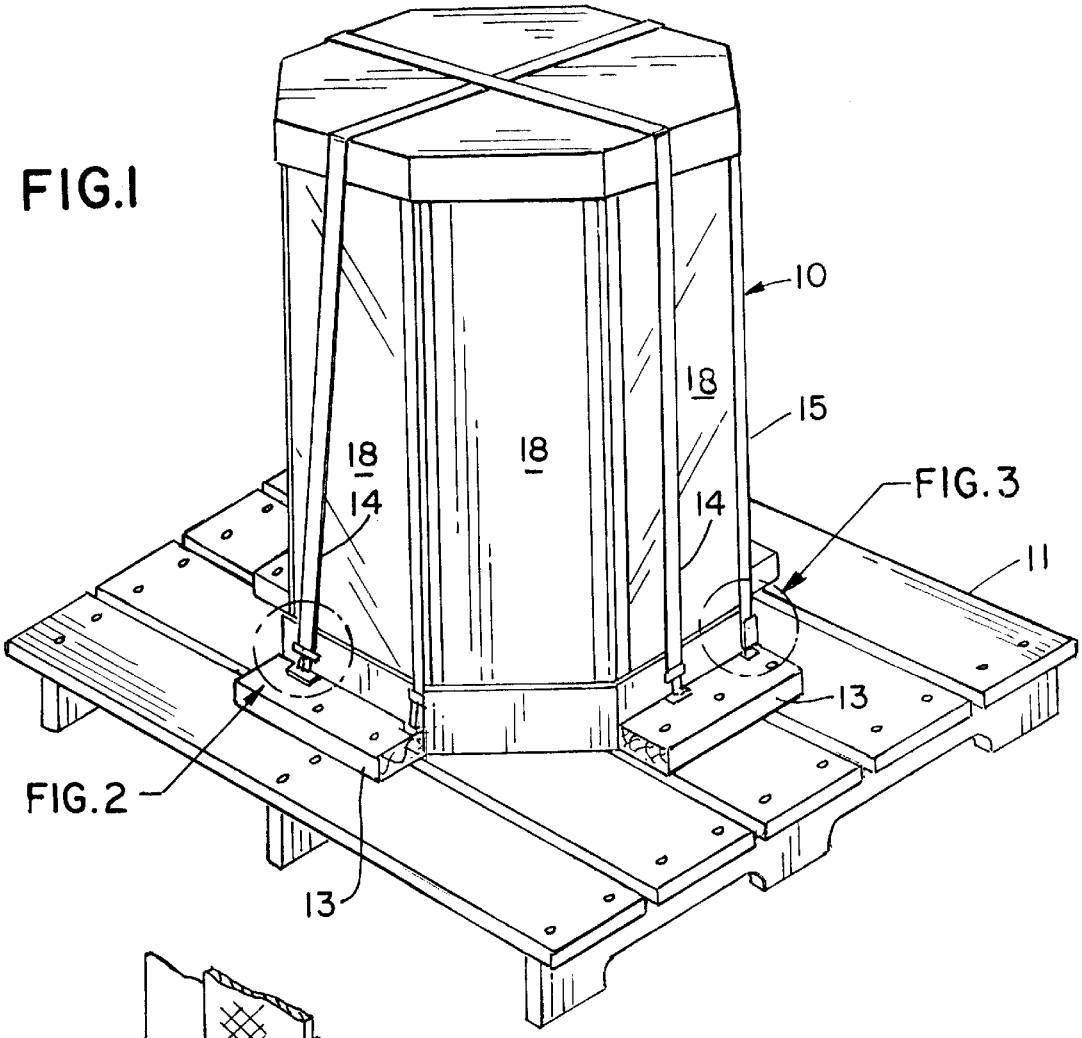
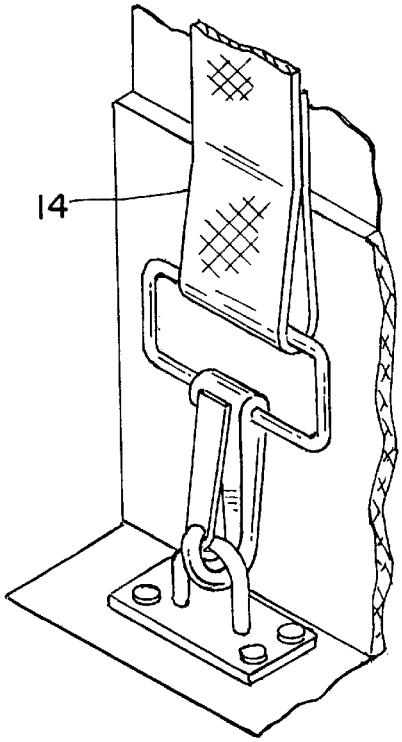
FIG.2
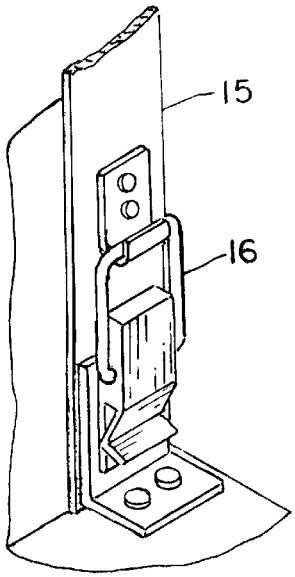
FIG.3

COLLAPSIBLE OCTAGONAL BOX FOR HEAVY LOAD (5,000+ POUNDS)

This invention relates to a collapsible box for shipments between plants of heavy loads up to 5,000+ pounds per box for heavy parts. The box is designed to be collapsible to be returned flat for less shipping costs. The box is fabricated in an octagonal shape made from 8 sides of hardboard on the outside, and a sheet of aluminum secured thereto with hinges holding the sides together in an octagon with strips holding the box on a pallet.

The hinges hold the sides together from the base on the pallet to the top of the box. The hinges are of two types. One hinge is a double pivot for opposite corners of the collapsed box, and it folds back on itself with two pivot points, shown in FIGS. 6 and 7. The other hinge folds from a flat position on the top or bottom of the collapsed position to a 45° bend inwardly toward the assembled box with only one pivot point, shown in FIG. 4 and 5.

Each of the panels making up the sides of the box has a ¼" hardboard, i.e. Masonite, secured to a layer of aluminum, perhaps made of 0.024 inch aluminum having a total thickness of 5/16 inches. Each of the hardboard panels has a groove about ⅛" deep and the same width into which a tongue on the hinges fits so that they can be slipped on to each of the hinges to provide some load bearing tension in the box circumferentially.

The collapsible box is then placed on its end fastened to a cap, or the top and bottom, and secured to a pallet for transport. The box is designed to hold 5,000+ pounds of metal or other parts for rail, ship, or truck transshipment. Inside the assembled box, there would be a suitable covering for the merchandise to provide protection against the elements. In the event of damage in shipping, replacement panels (that is aluminum sheets and hardboard) may be replaced.

DRAWINGS

In the drawing, FIG. 1 is a collapsible box fully assembled and attached to a pallet for shipping.

FIG. 2 is an enlarged view of the hold down straps for the box on the pallet.

FIG. 3 is a view of the locked down straps.

DETAILED DESCRIPTION THE COMPONENT OF THE COLLAPSIBLE OCTAGONAL BOX

The collapsible box is shown in FIG. 1 at 10, mounted on a shipping pallet 11, with lumber blocks 13 to hold it in position. The straps 14 hold the box firmly to the lumber block 13. Additional straps at 15 are mounted on lock down devices, 16, and increase the security for the box.

Figure 4:
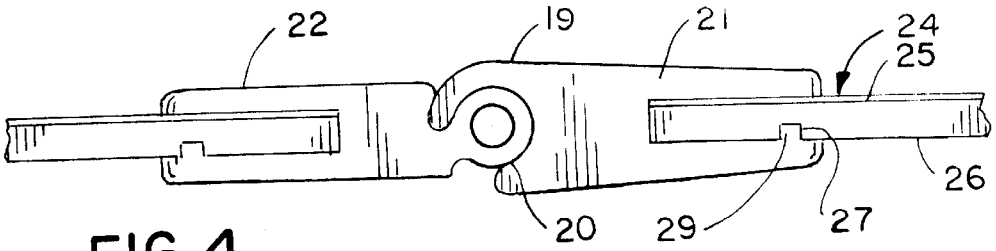
FIG. 4 is a view of the single pivot hinges.

The box has 8 sides as shown in 18, though it could be, 10, 12, 14, or 16. These would be hinged together as shown by the single pivot hinge shown in FIG. 4 at 19, which has a single pivot 20 with 2 bifurcated leaves at 21 and 22, as side panel 24 is slipped into the leaves. The side has a sheet of aluminum 25 glued to a hardboard 26 about ¼" thick having a groove 27 in the hardboard and a projection 29 formed into bifurcated leaves of the hinge 21 and 22. The hinge is designed to move through 45° when assembled.

Figure 5:
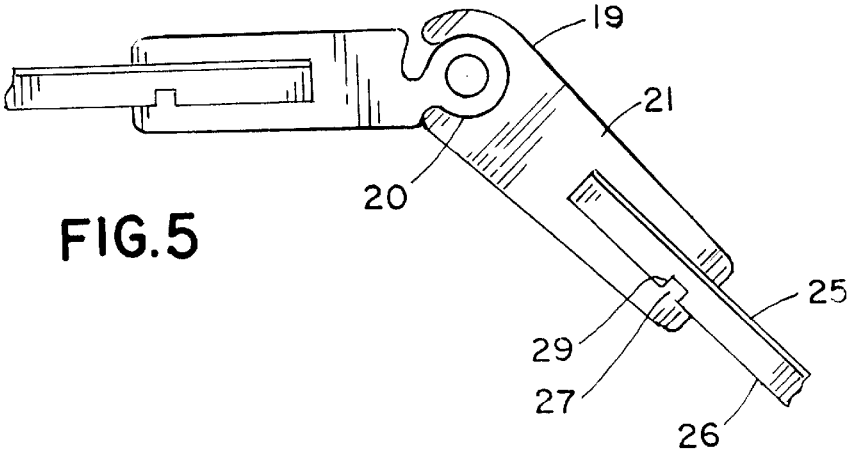
FIG. 5 is another, view of the single pivot hinge of FIG. 4 showing the limit of motion.
Figure 6:
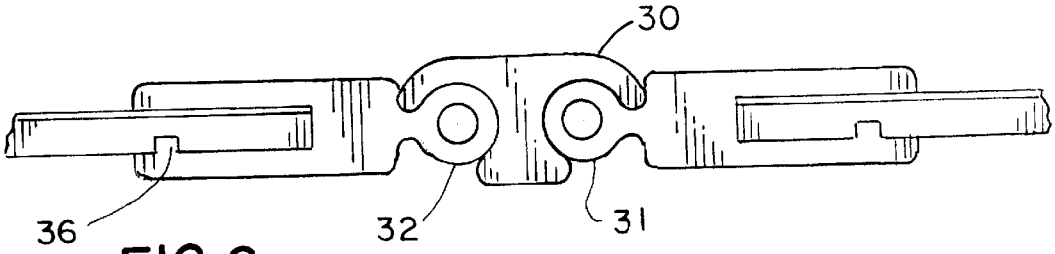
FIG. 6 is a view of the double pivot hinges that allows the box to fold flat for transship
Figure 7:
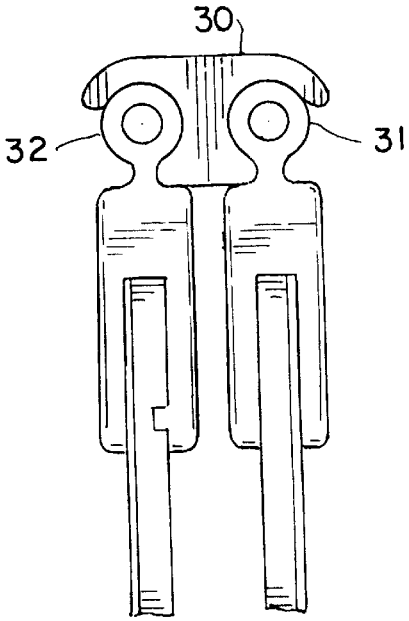
FIG. 7 shows the double pivot hinge fold flat for storage and return.

The double hinge pivot at which 2 pivots 31 and 32, shown in FIG. 6 and 7, is designed to move through 180° so that it may lie flat when shipped. The bifurcated leaves are similar to those in FIG. 4 and 5.

Figure 8:
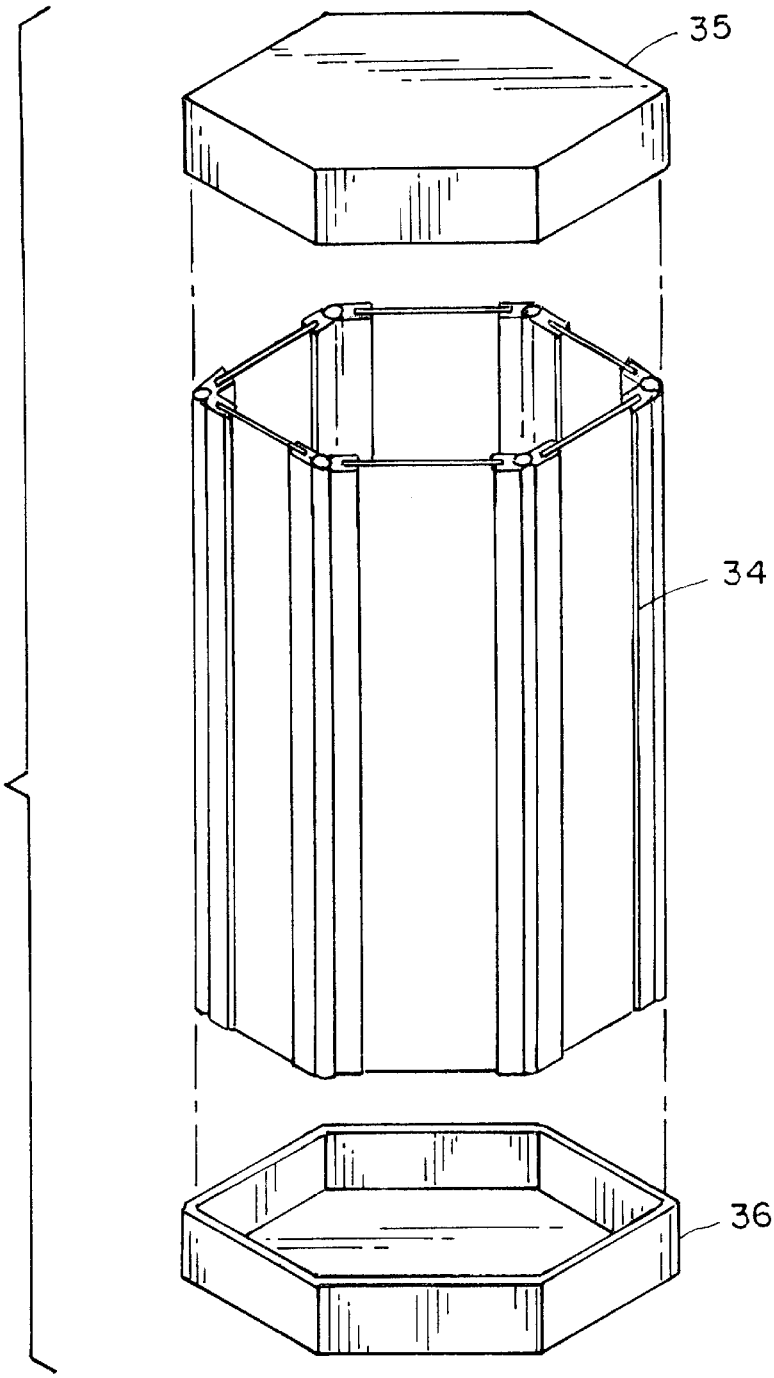
FIG. 8 is a schematic view of the box in open position.
Figure 9:
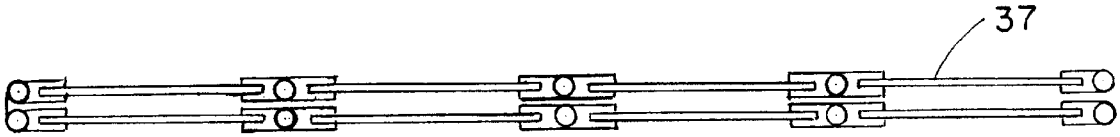
FIG. 9 is another view of t he box in a collapsed position.
Figure 10:
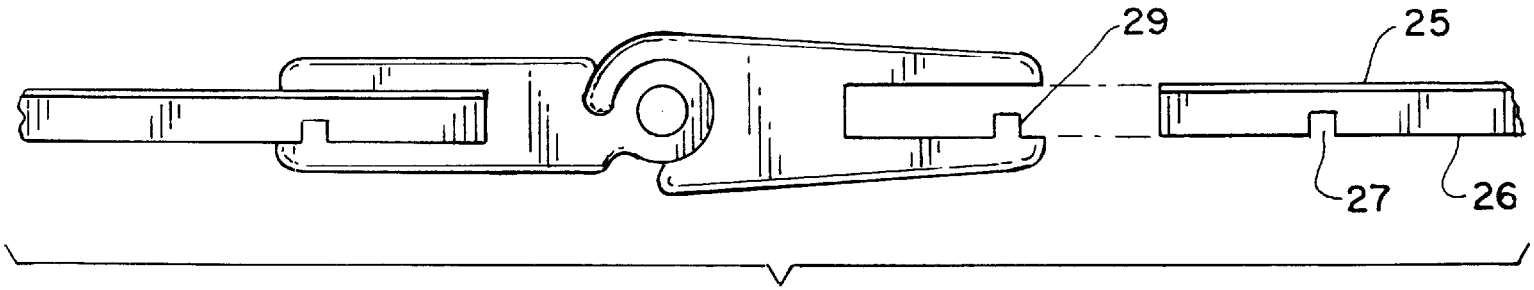
FIG. 10 is a view of the single pivot hinge and the metal clad panel before assembly.

FIG. 8 shows a schematic of the collapsible box 34 with 8 sides and a cardboard cap 35 with a bottom 36. FIG. 9 shows the box in a collapsed position for return shipment, shown at 37. FIG. 10 shows a hinge with the hardboard before they are assembled. The aluminum layer 25 is on top and the hardboard is at 26. The groove 27 and projection 29 are shown.

Figure 11:
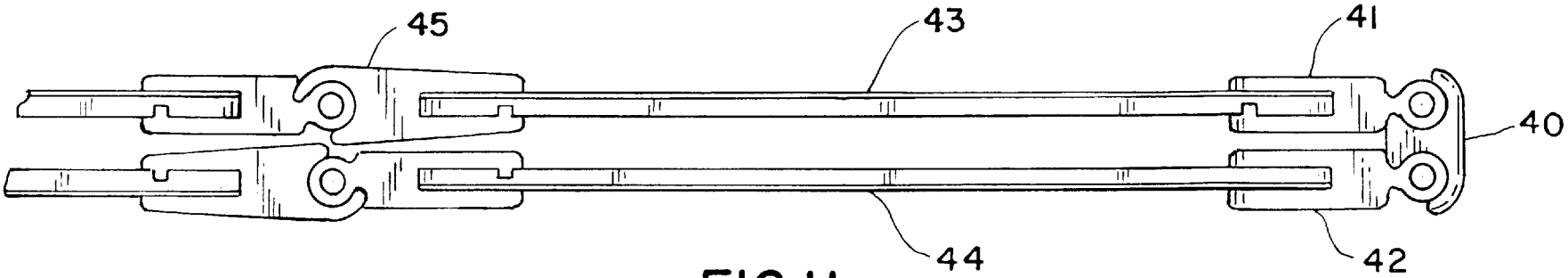
FIG. 11 is a view of one end of the octagonal box folded flat showing a single pivot, and a double pivot at one end of the box folded flat.

FIG. 11 shows the details of the collapsible box on the right end with a double pivot 40 with 2 bifurcated leaves 41 and 42. The sides of the box are shown at 43 on the top and 44 on the bottom. The single pivot is shown at 45.

Having thus disclosed all of the details of this collapsible box, I wish to be only limited by the claims which follow:

I claim:

1. A collapsible box for merchandise transshipment having a multiciplicity of panels and a covered top and a supporting bottom together with hinges between the panels extending from the top of the box to the bottom a) a multiplicity of equal sized panels formed in a collapsible box having an even number of panels b) said panels formed by securing a layer of sheet metal to a layer of hardboard coextensive therewith.

c) hinges of metal between the panels extending from the top of the box to the bottom d) said hinges having at least one pivot point and 2 leaves for securing the sides to the leaves of the hinge.

2. The box of claim 1 in which two opposite positioned hinges have two pivots and may fold back on themselves flat.

3. The box of claim 2 in which the other hinges or the box have a single pivot and only fold to a 45° angle.

4. The box of claim 1 in which the hard board has a groove in the hard board and a matching projection in the hinge allowing the projection to slip into the hinge as the projection slips in the groove allowing stresses to be shared with the aluminum sheet and the hard board to which it is secured.

5. The box of claim 4 in which each of the leaves of the hinge has a double set of leaves separated by the thickness of the hard board and the aluminum layer so that circumferential stresses in a loaded position can be accepted by the hinge and the aluminum and hardboard panel.

6. A collapsible transit container for reasonably heavy piece goods for shipping containers which are collapsible to be returned to the shipper for refilling said containers formed into an octagonal container with flat ends and eight sides hinged together, the sides of the container formed of hard board and a layer of aluminum on the outside glued to the hard board, said hinges formed of two types, all hinges extended the full highth of the container and one type to be angled to permit having a 135° included angle and a second type having two pivot points so the opposite sides of the hinge can pivot to be parallel to one and thus to allow the sides of the container to collapse flat for return transit, each attachment for the hinge having a tongue and groove arrangement to allow tension in the hinge as it accepts load in the container, and load supporting pallets for the container and its load and a cap for the octagonal container.

7. A collapsible transit container for heavy piece goods and fluent material, a) said container having at least 8 octagonal sides and being hinged together the full length of the container, whereby the container may collapse to a flat structure b) each of said sides being formed of hard board glued to a layer of aluminum for strength c) the hinges on the flat sides when collapsed being limited to an angular movement of 135° included angle when filled d) the hinges on the ends of the flat sides having 2 pivot points so the hinges may have substantially parallel sides to the hinge when the container is flat e) each side of both types of hinges having bifurcated leaves to enclose the sides of the aluminum hard board f) one side of the hinge being flat and the opposite having a tongue projecting toward the hard board side g) said hard board having a groove to allow assembly by sliding the tongue into the groove to provide greater tension in the hinged hard board connections when the container is loaded h) pallet support means for the container with the sides being vertical i) cap means on the octagonal container.

* * * * *